US009249751B2

(12) United States Patent
Jammoussi et al.

(10) Patent No.: US 9,249,751 B2
(45) Date of Patent: Feb. 2, 2016

(54) EXHAUST GAS SENSOR CONTROLS ADAPTATION FOR ASYMMETRIC DEGRADATION RESPONSES

(71) Applicant: Ford Global Technologies, LLC, Dearborn, MI (US)

(72) Inventors: Hassene Jammoussi, Houston, TX (US); Imad Hassan Makki, Dearborn Heights, MI (US); Michael James Uhrich, West Bloomfield, MI (US); Michael Casedy, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 314 days.

(21) Appl. No.: 13/901,441

(22) Filed: May 23, 2013

(65) Prior Publication Data

US 2014/0345584 A1 Nov. 27, 2014

(51) Int. Cl.

*F02D 41/30* (2006.01)
*F02D 41/14* (2006.01)
*F02D 41/22* (2006.01)

(52) U.S. Cl.

CPC ..... *F02D 41/30* (2013.01); *F02D 41/1482* (2013.01); *F02D 41/1483* (2013.01); *F02D 41/1495* (2013.01); *F02D 2041/1422* (2013.01); *F02D 2041/1431* (2013.01); *F02D 2041/1432* (2013.01); *F02D 2041/228* (2013.01)

(58) Field of Classification Search

CPC ... F02D 41/30; F02D 41/182; F02D 41/1456; F02D 41/1459; F01N 11/007
USPC ..... 123/299, 478, 672–674, 676; 701/103, 701/104, 114
See application file for complete search history.

(56) References Cited

U.S. PATENT DOCUMENTS

| | | | | |
|---|---|---|---|---|
| 6,481,427 | B1 * | 11/2002 | Javaherian | 123/673 |
| 2004/0187480 | A1 * | 9/2004 | Bidner et al. | 60/285 |
| 2005/0166900 | A1 * | 8/2005 | Song et al. | 123/481 |
| 2005/0193988 | A1 * | 9/2005 | Bidner et al. | 123/481 |
| 2005/0197761 | A1 * | 9/2005 | Bidner et al. | 701/105 |
| 2007/0119413 | A1 * | 5/2007 | Lewis et al. | 123/295 |
| 2007/0227123 | A1 * | 10/2007 | Iida et al. | 60/277 |
| 2012/0004827 | A1 * | 1/2012 | Tani et al. | 701/103 |
| 2013/0180510 | A1 | 7/2013 | Makki et al. | |
| 2013/0190509 | A1 | 7/2013 | Wang et al. | |
| 2013/0231844 | A1 | 9/2013 | Uhrich et al. | |
| 2013/0231847 | A1 | 9/2013 | Uhrich et al. | |

* cited by examiner

OTHER PUBLICATIONS

Jammoussi, Hassene et al., "Exhaust Gas Sensor Diagnosis and Controls Adaptation," U.S. Appl. No. 13/779,349, filed Feb. 27, 2013, 45 pages.

*Primary Examiner* — John Kwon
*Assistant Examiner* — Johnny H Hoang
(74) *Attorney, Agent, or Firm* — Julia Voutyras; Alleman Hall McCoy Russell & Tuttle LLP

(57) ABSTRACT

Methods and systems are provided for converting an asymmetric degradation response of an exhaust gas sensor to a more symmetric degradation response. In one example, a method includes adjusting fuel injection responsive to a modified exhaust oxygen feedback signal from an exhaust gas sensor, the modified exhaust oxygen feedback signal modified by transforming an asymmetric response of the exhaust gas sensor to a more symmetric response. Further, the method may include adjusting one or more parameters of an anticipatory controller of the exhaust gas sensor based on the modified symmetric response.

20 Claims, 8 Drawing Sheets

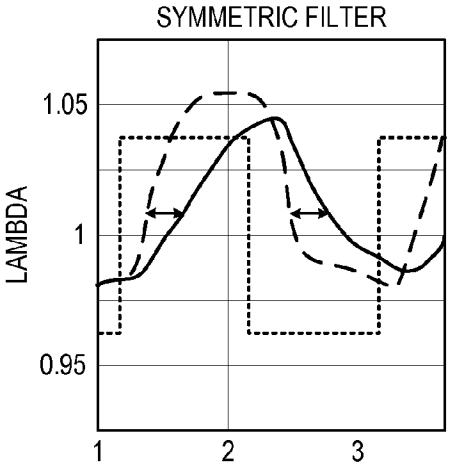
FIG. 2
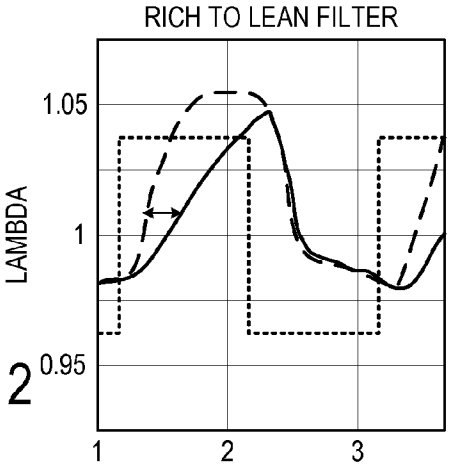
FIG. 3
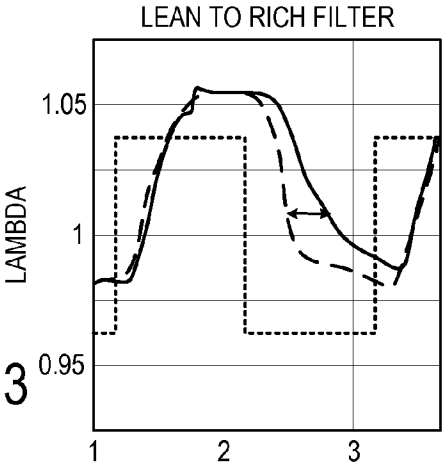
FIG. 4
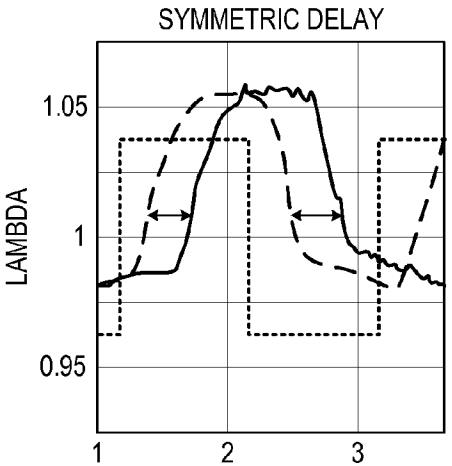
FIG. 5
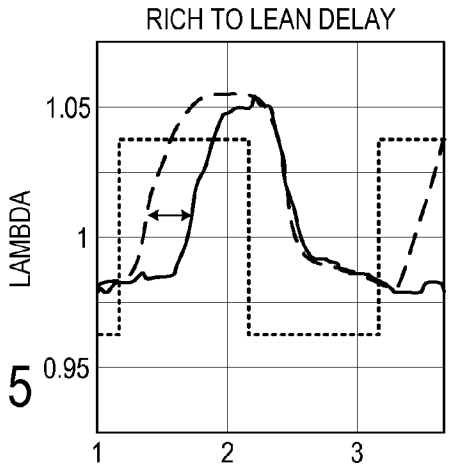
FIG. 6
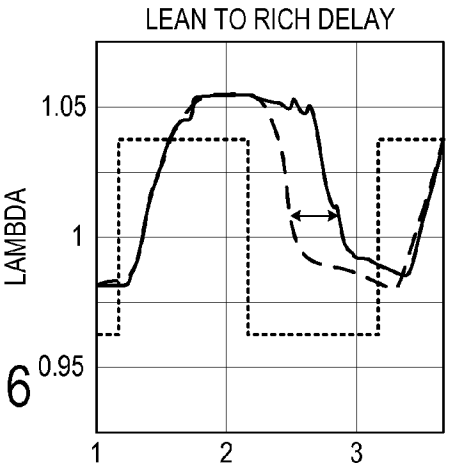
FIG. 7
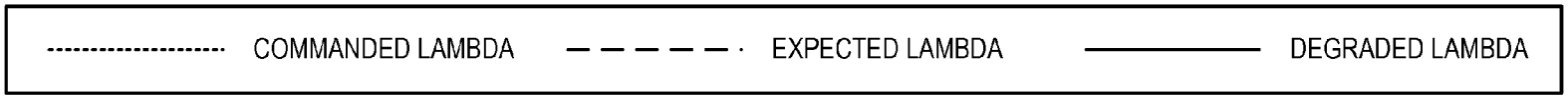

EXHAUST GAS SENSOR CONTROLS ADAPTATION FOR ASYMMETRIC DEGRADATION RESPONSES

BACKGROUND/SUMMARY

An exhaust gas sensor having an anticipatory controller may be positioned in an exhaust system of a vehicle to detect an air-fuel ratio of exhaust gas exhausted from an internal combustion engine of the vehicle. The exhaust gas sensor readings may be used to control operation of the internal combustion engine to propel the vehicle.

Degradation of the exhaust gas sensor may cause engine control degradation that may result in increased emissions and/or reduced vehicle drivability. Accordingly, accurate determination of exhaust gas sensor degradation and subsequent adjustments to parameters of the anticipatory controller may reduce the likelihood of engine control based on readings from a degraded exhaust gas sensor. In particular, an exhaust gas sensor may exhibit six discrete types of degradation behavior. The degradation behavior types may be grouped into filter type degradation behaviors and delay type degradation behaviors. Further, the degradation behavior types may either be symmetric or asymmetric around stoichiometry. An exhaust gas sensor exhibiting an asymmetric filter type degradation behavior may have a degraded time constant of the sensor reading in only one transition direction of the air-fuel ratio (e.g., rich-to-lean transition or lean-to-rich transition). In response to sensor degradation, anticipatory controller parameters may be adjusted to maintain stability of the closed-loop system operation.

Previous approaches to adjusting parameters of the anticipatory controller of an exhaust gas sensor, responsive to degraded behavior, include adjusting anticipatory controller gains only in the direction of the degradation. As a result, an engine controller may respond asymmetrically to deliver more or less fuel in the direction of the degradation. This asymmetric operation may cause an increase in CO emissions (lean-to-rich filter) or an increase in NOx (rich-to-lean filter).

The inventors herein have recognized the above issues and identified an approach for adjusting fuel injection to an engine responsive to a modified exhaust oxygen feedback signal from an exhaust gas sensor, the modified exhaust oxygen feedback signal modified by transforming an asymmetric response of the exhaust gas sensor to a modified more symmetric response, for example a modified symmetric response. For example, the asymmetric response may be an asymmetric filter degradation response wherein a response rate of the response is degraded in only one transition direction, or degraded to a greater extent in one direction than another. In one example, transforming the asymmetric response to the modified symmetric response may include filtering a non-degraded portion (e.g., transition direction) of the asymmetric response by an amount based on a time constant of a degraded portion of the asymmetric response. After transforming the asymmetric response, one or more parameters of an anticipatory controller of the exhaust gas sensor may be adjusted based on the modified symmetric response. For example, one or more of a proportional gain, an integral gain, a controller time constant, and a controller time delay may be adjusted and applied in both transition directions of the exhaust gas sensor response. In this way, a technical effect of the anticipatory controller being able to operate symmetrically may be achieved, thereby reducing calibration work of the controller and reducing NOx and CO emissions of the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a graph indicating a symmetric filter type degradation behavior of an exhaust gas sensor.

FIG. 3 shows a graph indicating an asymmetric rich-to-lean filter type degradation behavior of an exhaust gas sensor.

FIG. 4 shows a graph indicating an asymmetric lean-to-rich filter type degradation behavior of an exhaust gas sensor.

FIG. 5 show a graph indicating a symmetric delay type degradation behavior of an exhaust gas sensor.

FIG. 6 shows a graph indicating an asymmetric rich-to-lean delay type degradation behavior of an exhaust gas sensor.

FIG. 7 shows a graph indicating an asymmetric lean-to-rich delay type degradation behavior of an exhaust gas sensor.

DETAILED DESCRIPTION

Figure 1:
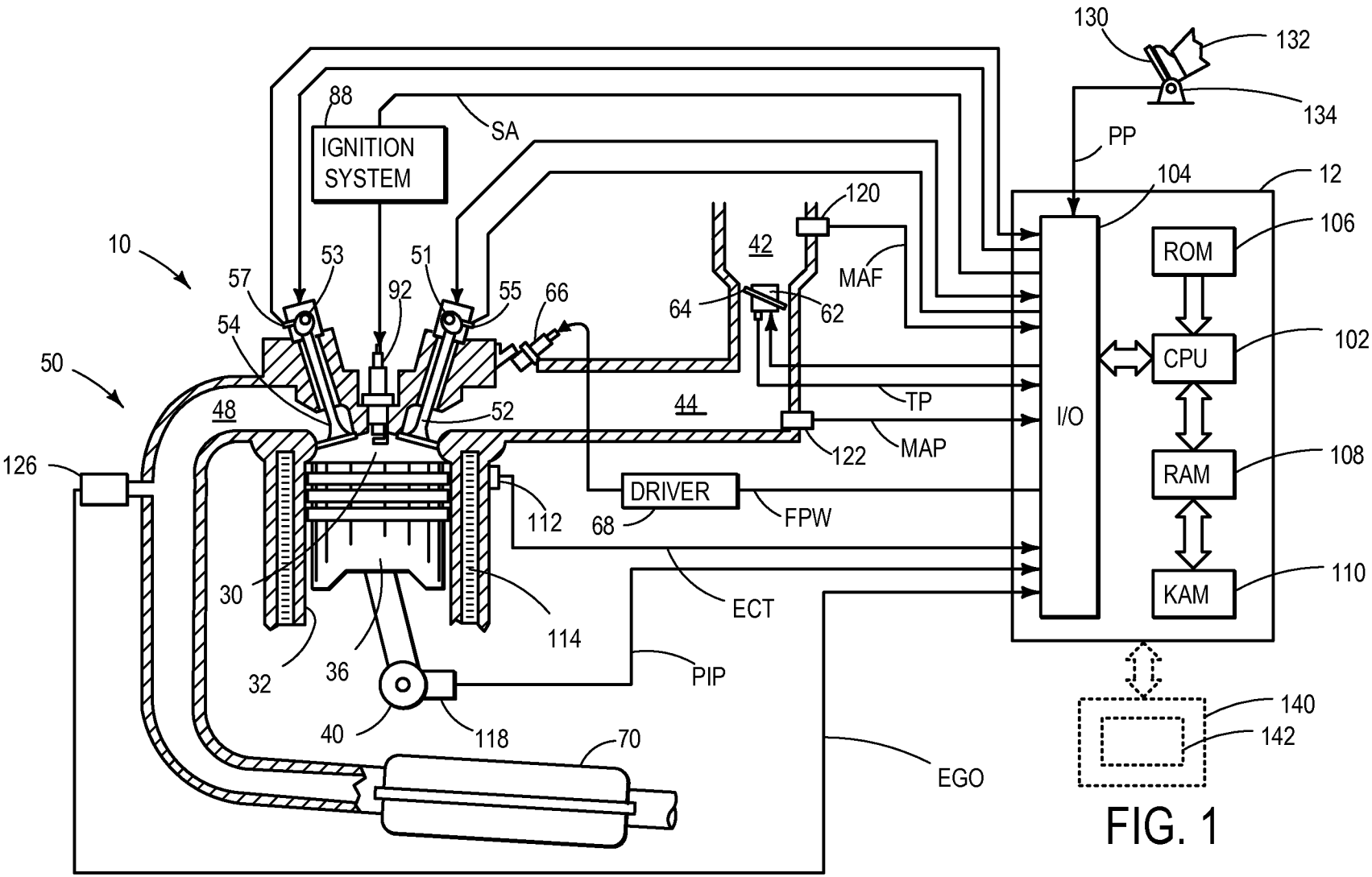
FIG. 1 shows a schematic diagram of an embodiment of a propulsion system of a vehicle including an exhaust gas sensor.
Figure 9:
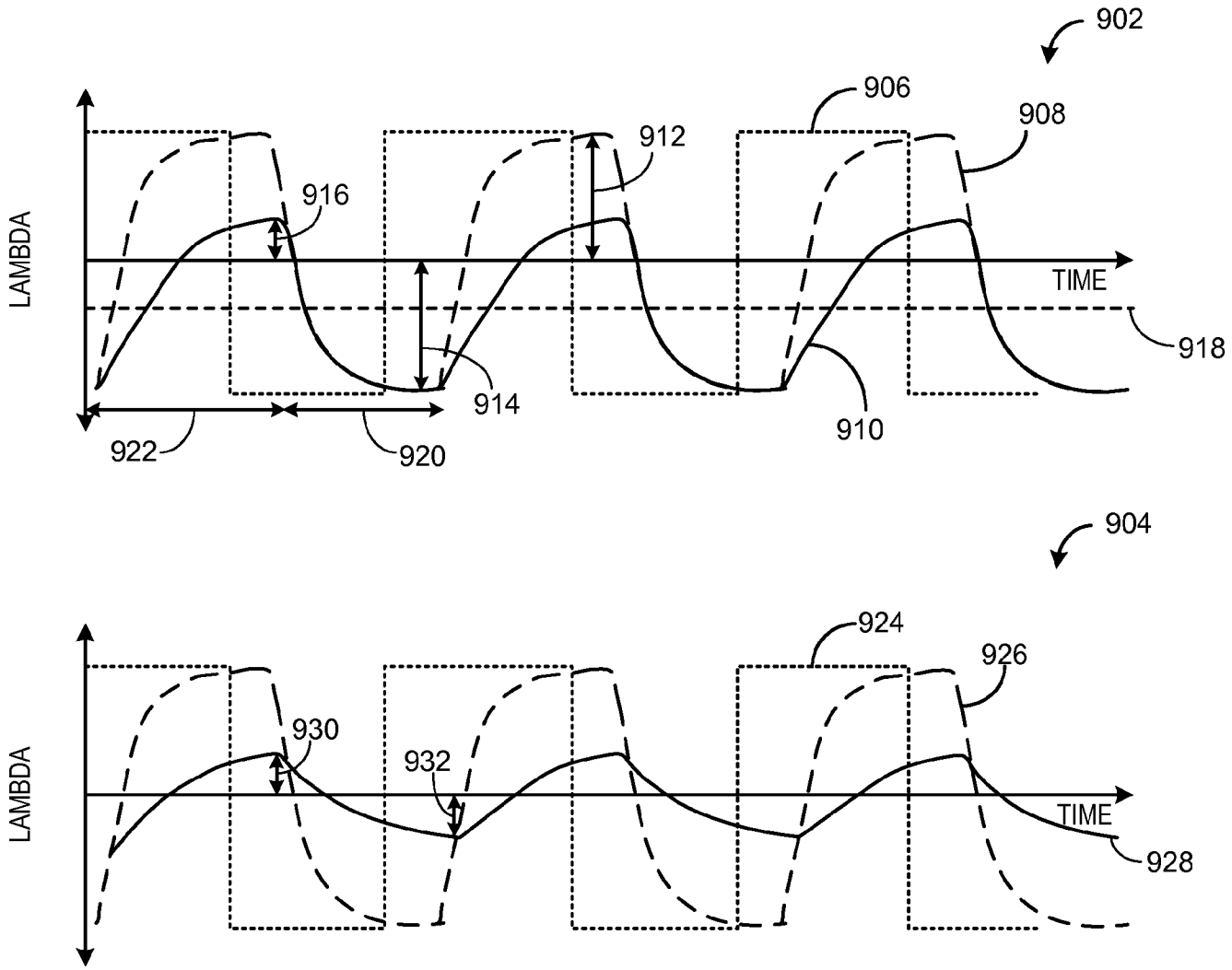
FIG. 9 shows graphs of an example modified symmetric filter degradation response transformed from an asymmetric filter degradation response of an exhaust gas sensor.
Figure 10:
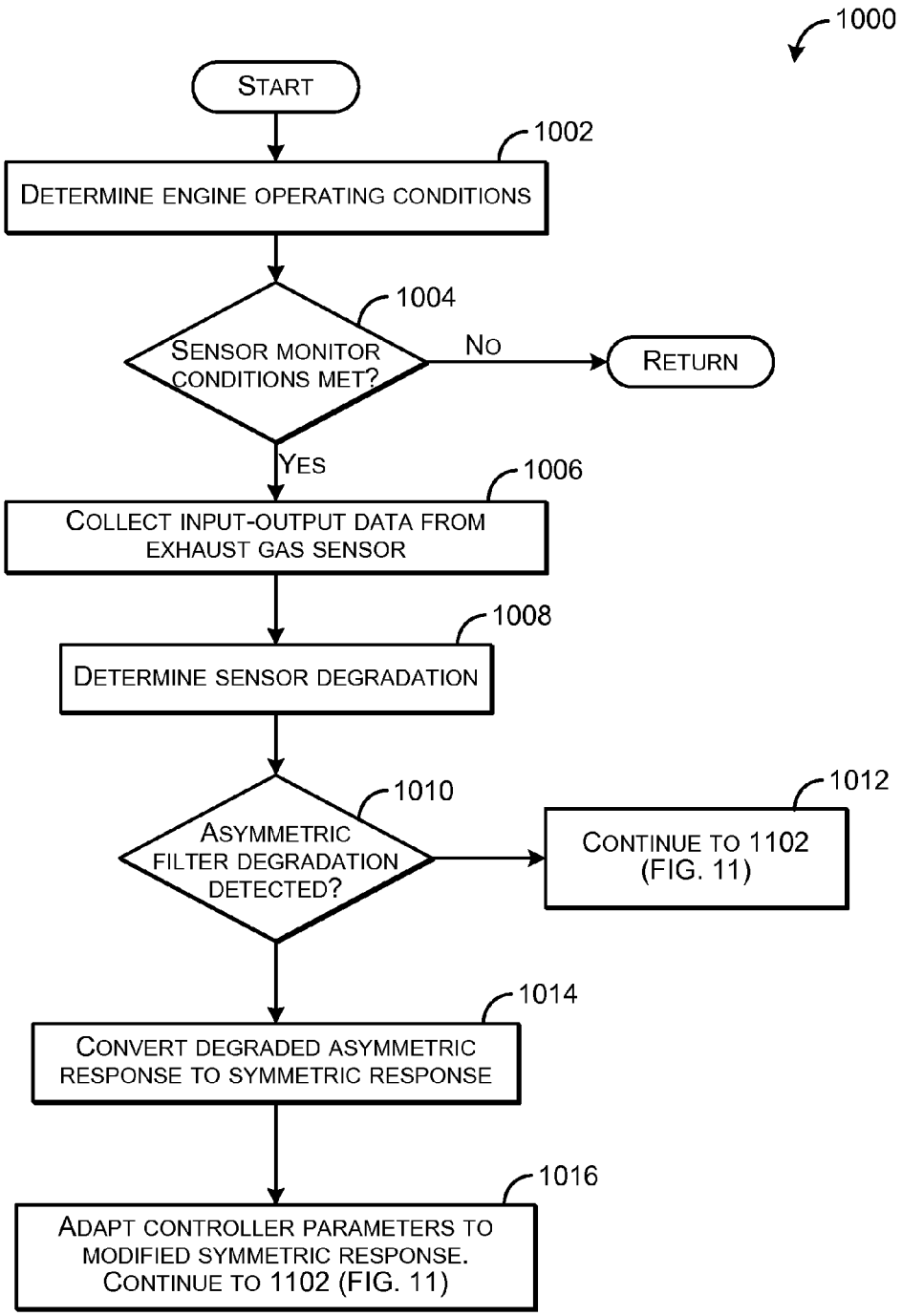
FIG. 10 is a flow chart illustrating a method for converting an asymmetric filter degradation response of an exhaust gas sensor to a more symmetric filter degradation response.
Figure 11:
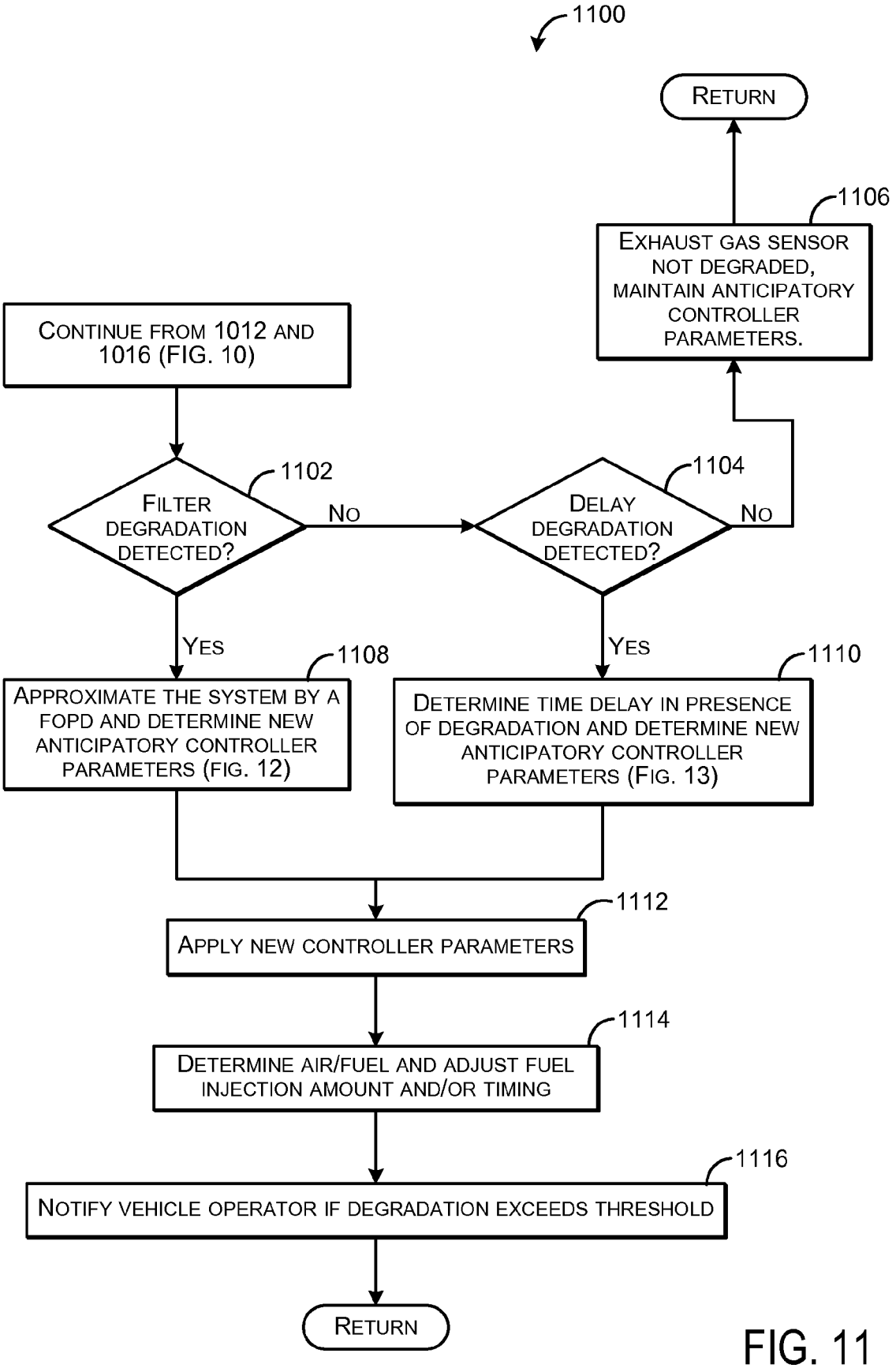
FIG. 11 is a flow chart illustrating a method for adjusting parameters of an anticipatory controller of an exhaust gas sensor, based on a type and magnitude of degradation.
Figure 12:
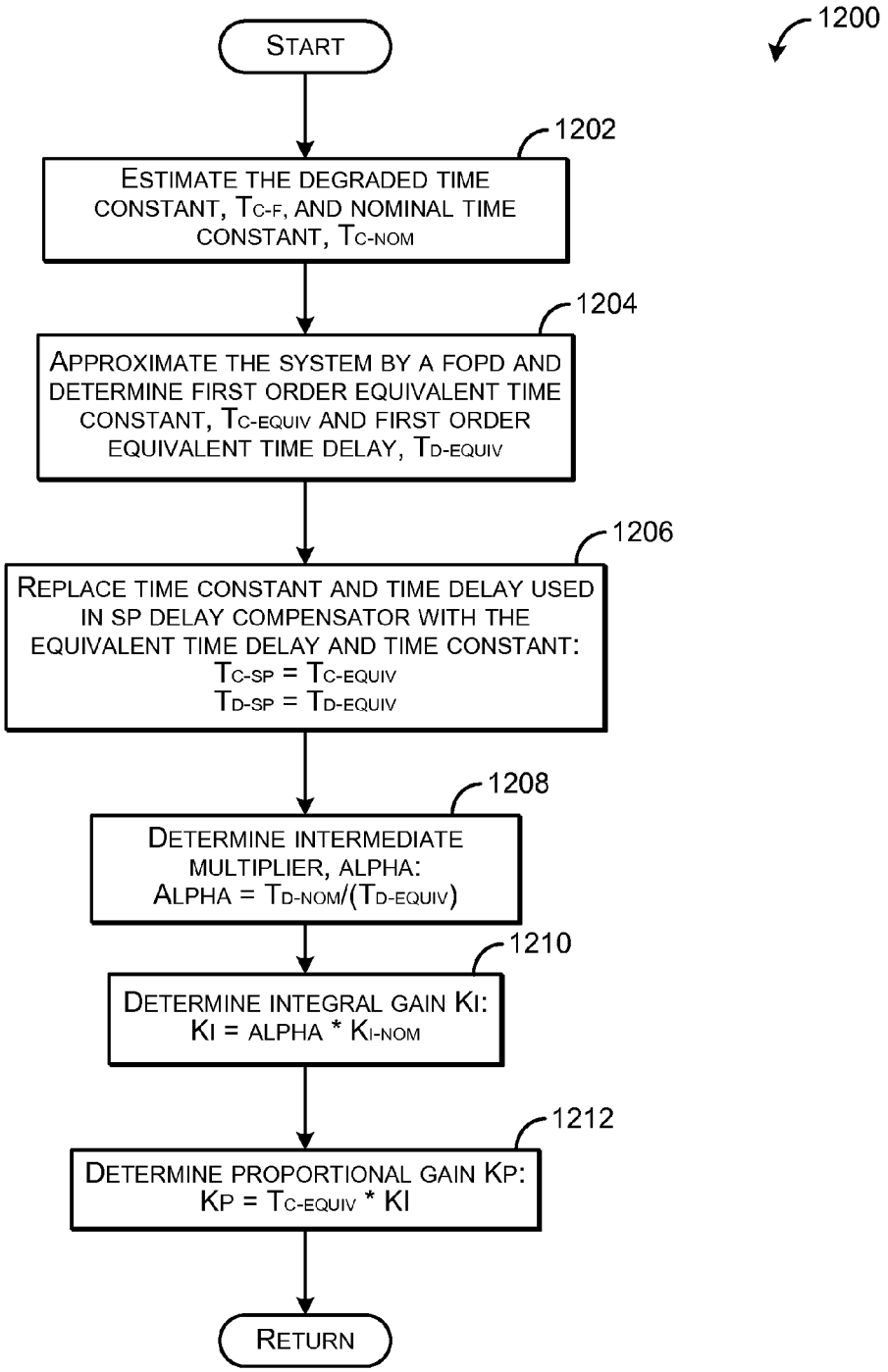
FIG. 12 is a flow chart illustrating a method for determining adjusted parameters of the anticipatory controller of the exhaust gas sensor based on filter degradation behavior.
Figure 13:
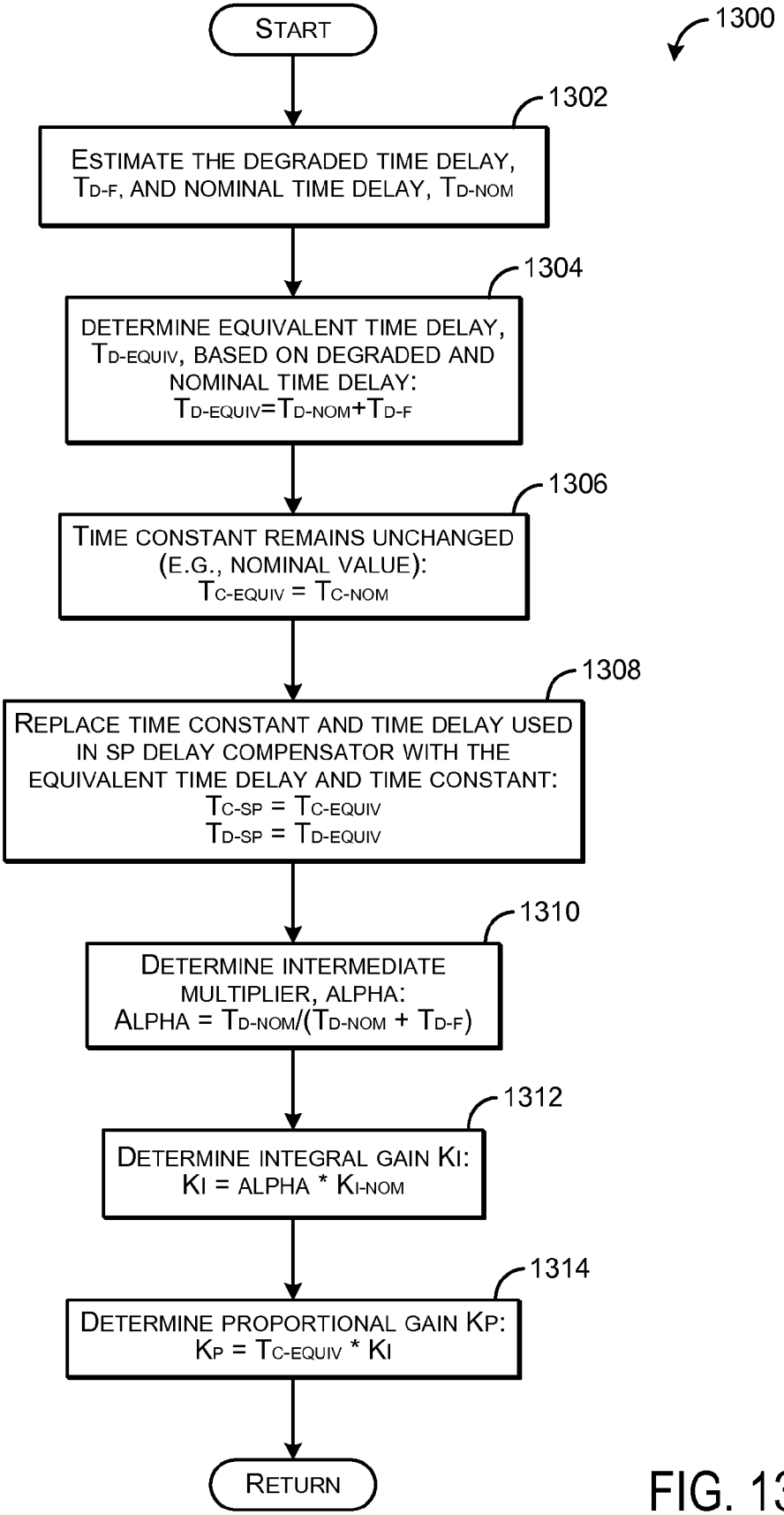
FIG. 13 is a flow chart illustrating a method for determining adjusted parameters of the anticipatory controller of the exhaust gas sensor based on delay degradation behavior.

The following description relates to systems and methods for converting an asymmetric degradation response of an exhaust gas sensor, such as the exhaust gas sensor depicted in FIG. 1, to a modified symmetric degradation response. Specifically, the asymmetric degradation response may be an asymmetric degradation filter type response of the exhaust gas sensor, as shown in FIGS. 3-4. Six types of degradation behavior of the exhaust gas sensor (e.g., exhaust oxygen sensor), including the asymmetric degradation filter type responses, are presented at FIGS. 2-7. FIG. 9 shows an example of a modified symmetric filter degradation response obtained by filtering a non-degraded portion of an asymmetric filter degradation response. The modified symmetric filter degradation response may be based on a time constant of a degraded portion of the asymmetric filter degradation response. FIG. 10 presents an example method for converting the asymmetric filter degradation response to the modified symmetric filter degradation response. Parameters of an anticipatory controller of the exhaust gas sensor may then be adjusted based on a magnitude of the modified filter degradation response. In one example, the magnitude of the modified filter degradation response may be substantially the same as a magnitude (e.g., time constant) of the degraded portion of the asymmetric filter degradation response. FIGS. 11-13 show methods for determining the adjusted anticipatory controller parameters based on the degradation behavior. In the case of the asymmetric filter degradation behavior, the adjusted anticipatory controller parameters may be applied in both transition directions (e.g., lean-to-rich and rich-to-lean), thereby making operations of the anticipatory controller symmetrical. As such, calibration work of the controller may be reduced while also reducing NOx and CO emissions of the engine.

FIG. 1 is a schematic diagram showing one cylinder of multi-cylinder engine 10, which may be included in a propulsion system of a vehicle in which an exhaust gas sensor 126 may be utilized to determine an air-fuel ratio of exhaust gas produced by engine 10. The air-fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. A throttle 62 including a throttle plate 64 may be provided between the intake manifold 44 and the intake passage 42 for varying the flow rate and/or pressure of intake air provided to the engine cylinders. Adjusting a position of the throttle plate 64 may increase or decrease the opening of the throttle 62, thereby changing mass air flow, or the flow rate of intake air entering the engine cylinders. For example, by increasing the opening of the throttle 62, mass air flow may increase. Conversely, by decreasing the opening of the throttle 62, mass air flow may decrease. In this way, adjusting the throttle 62 may adjust the amount of air entering the combustion chamber 30 for combustion. For example, by increase mass air flow, torque output of the engine may increase.

Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Exhaust gas sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. In some embodiments, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Furthermore, at least some of the above described signals may be used in various exhaust gas sensor degradation determination methods, described in further detail below. For example, the inverse of the engine speed may be used to determine delays associated with the injection-intake-compression-expansion-exhaust cycle. As another example, the inverse of the velocity (or the inverse of the MAF signal) may be used to determine a delay associated with travel of the exhaust gas from the exhaust valve 54 to exhaust gas sensor 126. The above described examples along with other use of engine sensor signals may be used to determine the time delay between a change in the commanded air-fuel ratio and the exhaust gas sensor response rate.

In some embodiments, exhaust gas sensor degradation determination and calibration may be performed in a dedicated controller 140. Dedicated controller 140 may include processing resources 142 to handle signal-processing associated with production, calibration, and validation of the degradation determination of exhaust gas sensor 126. In particular, a sample buffer (e.g., generating approximately 100 samples per second per engine bank) utilized to record the response rate of the exhaust gas sensor may be too large for the processing resources of a powertrain control module (PCM) of the vehicle. Accordingly, dedicated controller 140 may be operatively coupled with controller 12 to perform the exhaust gas sensor degradation determination. Note that dedicated controller 140 may receive engine parameter signals from controller 12 and may send engine control signals and degradation determination information among other communications to controller 12.

The exhaust gas sensor 126 may comprise an anticipatory controller. In one example, the anticipatory controller may include a PI controller and a delay compensator, such as a Smith Predictor (e.g., SP delay compensator). The PI controller may comprise a proportional gain, $K_P$, and an integral gain, $K_I$. The Smith Predictor may be used for delay compensation and may include a time constant, $T_{C-SP}$, and time delay, $T_{D-SP}$. As such, the proportional gain, integral gain, controller time constant, and controller time delay may be parameters of the anticipatory controller of the exhaust gas sensor. Adjusting these parameters may alter the output of the exhaust gas sensor 126. For example, adjusting the above parameters may change the response rate of air-fuel ratio readings generated by the exhaust gas sensor 126. In response to degradation of the exhaust gas sensor, the controller parameters listed above may be adjusted to compensate for the degradation and increase the accuracy of air-fuel ratio readings, thereby increasing engine control and performance. The dedicated controller 140 may be communicably coupled to the anticipatory controller. As such, the dedicated controller 140 and/or controller 12 may adjust the parameters of the anticipatory controller based on the type of degradation determined using any of the available diagnostic methods, as described below. In one example, the exhaust gas sensor controller parameters may be adjusted based on the magnitude and type of degradation. In another example, the dedicated controller 140 and/or controller 12 may transform or modify a degraded response or signal from the exhaust gas sensor and then adjust the controller parameter based on the modified degraded response. Six types of degradation behaviors are discussed below with reference to FIGS. 2-7. Further details on adjusting the gains, time constant, and time delay of the exhaust gas sensor controller, as well as modifying a degraded response of the exhaust gas sensor, are presented below with reference to FIGS. 9-13.

Note storage medium read-only memory chip 106 and/or processing resources 142 can be programmed with computer readable data representing instructions executable by processor 102 and/or dedicated controller 140 for performing the methods described below as well as other variants.

As discussed above, exhaust gas sensor degradation may be determined based on any one, or in some examples each, of six discrete behaviors indicated by delays in the response rate of air-fuel ratio readings generated by an exhaust gas sensor during rich-to-lean transitions and/or lean-to-rich transitions. FIGS. 2-7 each show a graph indicating one of the six discrete types of exhaust gas sensor degradation behaviors. The graphs plot air-fuel ratio (lambda) versus time (in seconds). In each graph, the dotted line indicates a commanded lambda signal that may be sent to engine components (e.g., fuel injectors, cylinder valves, throttle, spark plug, etc.) to generate an air-fuel ratio that progresses through a cycle comprising one or more lean-to-rich transitions and one or more rich-to-lean transitions. The dashed line indicates an expected lambda response time of an exhaust gas sensor. Further, in each graph, the solid line indicates a degraded lambda signal that would be produced by a degraded exhaust gas sensor in response to the commanded lambda signal. In each of the graphs, the double arrow lines indicate where the given degradation behavior type differs from the expected lambda signal.

The system of FIG. 1 may provide for a system for a vehicle including an engine including a fuel injection system and an exhaust gas sensor coupled in an exhaust gas system of the engine, the exhaust gas sensor having an anticipatory controller. The system may further include a controller including instructions executable to transform an asymmetric degradation response of the exhaust sensor to a modified symmetric degradation response based on a magnitude and direction of the asymmetric degradation response. The instructions executable to transform the asymmetric degradation response may include filtering a non-degraded transition direction of the asymmetric degradation response based on a time constant of a degraded transition direction of the asymmetric degradation response. The instruction may further include adjusting one or more parameters of the anticipatory controller responsive to the modified symmetric degradation response, wherein an amount of adjusting is based on a magnitude of the modified symmetric degradation response. Further, an amount of fuel and/or timing of the fuel injection system may be adjusted based on exhaust oxygen feedback from the anticipatory controller.

FIG. 2 shows a graph indicating a first type of degradation behavior that may be exhibited by a degraded exhaust gas sensor. This first type of degradation behavior is a symmetric filter type that includes slow exhaust gas sensor response to the commanded lambda signal for both rich-to-lean and lean-to-rich modulation. In other words, the degraded lambda signal may start to transition from rich-to-lean and lean-to-rich at the expected times but the response rate may be lower than the expected response rate, which results in reduced lean and rich peak times.

FIG. 3 shows a graph indicating a second type of degradation behavior that may be exhibited by a degraded exhaust gas sensor. The second type of degradation behavior is an asymmetric rich-to-lean filter type that includes slow exhaust gas sensor response to the commanded lambda signal for a transition from rich-to-lean air-fuel ratio. This behavior type may start the transition from rich-to-lean at the expected time but the response rate may be lower than the expected response rate, which may result in a reduced lean peak time. This type of behavior may be considered asymmetric because the response of the exhaust gas sensor is slow (or lower than expected) during the transition from rich-to-lean. In response to this type of degradation behavior, the controller may deliver less fuel during rich-to-lean transitions. As a result, NOx emissions may increase.

FIG. 4 shows a graph indicating a third type of degradation behavior that may be exhibited by a degraded exhaust gas sensor. The third type of behavior is an asymmetric lean-to-rich filter type that includes slow exhaust gas sensor response to the commanded lambda signal for a transition from lean-to-rich air-fuel ratio. This behavior type may start the transition from lean-to-rich at the expected time but the response rate may be lower than the expected response rate, which may result in a reduced rich peak time. This type of behavior may be considered asymmetric because the response of the exhaust gas sensor is only slow (or lower than expected) during the transition from lean-to-rich. In response to this type of degradation behavior, the controller may deliver more fuel during lean-to-rich transitions. As a result, CO emissions may increase.

FIG. 5 shows a graph indicating a fourth type of degradation behavior that may be exhibited by a degraded exhaust gas sensor. This fourth type of degradation behavior is a symmetric delay type that includes a delayed response to the commanded lambda signal for both rich-to-lean and lean-to-rich modulation. In other words, the degraded lambda signal may start to transition from rich-to-lean and lean-to-rich at times that are delayed from the expected times, but the respective transition may occur at the expected response rate, which results in shifted lean and rich peak times.

FIG. 6 shows a graph indicating a fifth type of degradation behavior that may be exhibited by a degraded exhaust gas sensor. This fifth type of degradation behavior is an asymmetric rich-to-lean delay type that includes a delayed response to the commanded lambda signal from the rich-to-lean air-fuel ratio. In other words, the degraded lambda signal may start to transition from rich-to-lean at a time that is delayed from the expected time, but the transition may occur at the expected response rate, which results in shifted and/or reduced lean peak times. This type of behavior may be considered asymmetric because the response of the exhaust gas sensor is only delayed from the expected start time during a transition from rich-to-lean.

FIG. 7 shows a graph indicating a sixth type of degradation behavior that may be exhibited by a degraded exhaust gas sensor. This sixth type of behavior is an asymmetric lean-to-rich delay type that includes a delayed response to the commanded lambda signal from the lean-to-rich air-fuel ratio. In other words, the degraded lambda signal may start to transition from lean-to-rich at a time that is delayed from the expected time, but the transition may occur at the expected response rate, which results in shifted and/or reduced rich peak times. This type of behavior may be considered asymmetric because the response of the exhaust gas sensor is only delayed from the expected start time during a transition from lean-to-rich.

The six degradation behaviors of the exhaust gas sensor described above may be divided into two groups. The first group includes the filter type degradation wherein the response rate of the air-fuel ratio reading decreases (e.g., response lag increases). As such, the time constant of the response may change. The second group includes the delay type degradation wherein the response time of the air-fuel ratio reading is delayed. As such, the time delay of the air-fuel ratio response may increase from the expected response.

A filter type degradation and a delay type degradation affect the dynamic control system of the exhaust gas sensor differently. In response to a degraded response of the exhaust gas sensor, control compensation within the anticipatory controller may be required to maintain stability of the control system. Thus, in response to degradation of the exhaust gas sensor, the anticipatory controller parameters may be adjusted to compensate for the degradation and increase the accuracy of air-fuel ratio readings, thereby increasing engine control and performance. For example, if a delay type degradation is detected, a new controller time delay and gains may be determined based on the degraded time delay of the response. If a filter type degradation is detected, a new controller time constant, time delay, and gains may be determined based on the degraded time constant of the response.

However, if the filter type degradation is asymmetric, adjusting the anticipatory controller gains and delay compensation parameters in the direction of the degradation may only maintain the stability of the closed-loop fuel control system operation. This may not be enough to allow the engine control system to operate around stoichiometry, thereby requiring further calibration of the anticipatory controller based on the severity (e.g., magnitude) of the asymmetric filter degradation. However, by transforming the asymmetric filter degradation into a more symmetric filter degradation, the operation of the closed-loop system may be maintained around stoichiometry and the lean and/or rich bias caused by the asymmetric operation may be compensated for. Further details on compensating for and correcting asymmetric sensor responses, as well as adjusting controller parameters of the exhaust gas sensor, are described further below with reference to FIGS. 9-13.

Figure 8:
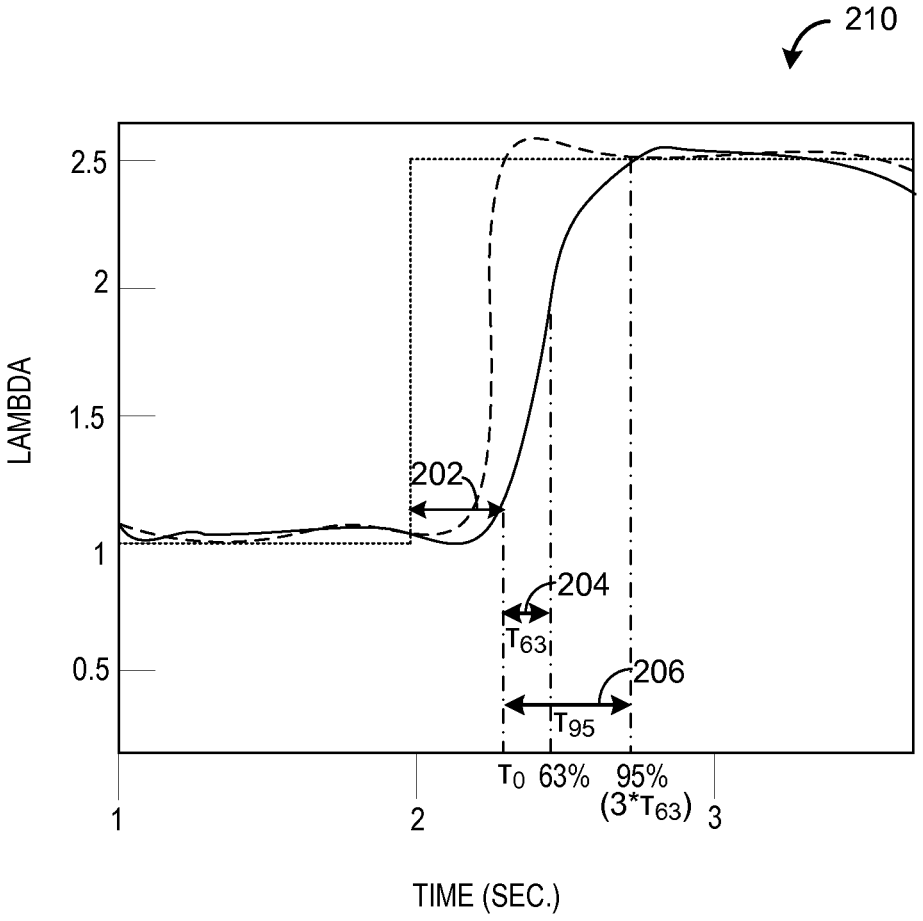
FIG. 8 shows a graph of an example degraded exhaust gas sensor response to a commanded entry into DFSO.

Various methods may be used for diagnosing degraded behavior of the exhaust gas sensor. In one example, degradation may be indicated based on a time delay and line length of each sample of a set of exhaust gas sensor response collected during a commanded change in air-fuel ratio. FIG. 8 illustrates an example of determining a time delay and line length from an exhaust gas sensor response to a commanded entry into DFSO. Specifically, FIG. 8 shows a graph 210 illustrating a commanded lambda, expected lambda, and degraded lambda, similar to the lambdas described with respect to FIGS. 2-7. FIG. 8 illustrates a rich-to-lean and/or symmetric delay degradation wherein the time delay to respond to the commanded air-fuel ratio change is delayed. The arrow 202 illustrates the time delay, which is the time duration from the commanded change in lambda to a time ($\tau_0$) when a threshold change in the measured lambda is observed. The threshold change in lambda may be a small change that indicates the response to the commanded change has started, e.g., 5%, 10%, 20%, etc. The arrow 204 indicates the time constant ($\tau_{63}$) for the response, which in a first order system is the time from $\tau_0$ to when 63% of the steady state response is achieved. The arrow 206 indicates the time duration from $\tau_0$ to when 95% of the desired response is achieved, otherwise referred to as a threshold response time ($\tau_{95}$). In a first order system, the threshold response time ($\tau_{95}$) is approximately equal to three time constants ($3*\tau_{63}$).

From these parameters, various details regarding the exhaust gas sensor response can be determined. First, the time delay, indicated by arrow 202, may be compared to an expected time delay to determine if the sensor is exhibiting a delay degradation behavior. Second, the time constant, indicated by the arrow 204, may be used to predict a $\tau_{95}$. Finally, a line length, indicated by the arrow 206, may be determined based on the change in lambda over the duration of the response, starting at $\tau_0$. The line length is the sensor signal length, and can be used to determine if a response degradation (e.g., filter type degradation) is present. The line length may be determined based on the equation:

$$\text{line length}=\Sigma\sqrt{\Delta t^2+\Delta\lambda^2}$$

If the determined line length is greater than an expected line length, the exhaust gas sensor may be exhibiting a filter type degradation. A time constant and/or time delay of the degraded exhaust gas sensor response may be used by the controller to adjust parameters of the exhaust gas sensor controller. Methods for adjusting the exhaust gas sensor controller parameters based on the degradation behavior are presented below at FIGS. 10-13.

In another example, exhaust gas sensor degradation may be indicated by monitoring characteristics of a distribution of extreme values from multiple sets of successive lambda samples in steady state operating conditions. In one example, the characteristics may be a mode and central peak of a generalized extreme value (GEV) distribution of the extreme lambda differentials collected during steady state operating conditions. Asymmetric delay or asymmetric slow response degradation may be determined based on the magnitude of the central peak and/or the magnitude of the mode. Further classification, for example symmetric delay or symmetric slow response, may be based on a determined sensor delay or a determined sensor time constant. Specifically, if the determined sensor time delay is greater than a nominal time delay, a sensor symmetric delay is indicated (e.g., indicates delay type degradation). The nominal sensor time delay is the expected delay in sensor response to a commanded air-fuel ratio change based on the delay from when the fuel is injected, combusted, and the exhaust travels from the combustion chamber to the exhaust sensor. The determined time delay may be when the sensor actually outputs a signal indicating the changed air-fuel ratio. Similarly, if the determined sensor time constant is greater than a nominal time constant, a sensor symmetric response degradation behavior is indicated (e.g., indicates filter type degradation). The nominal time constant may be the time constant indicating how quickly the sensor responds to a commanded change in lambda, and may be determined off-line based on non-degraded sensor function. As discussed above, the determined time constant and/or time delay of the degraded exhaust gas sensor response may be used by the controller to adjust parameters of the exhaust gas sensor controller.

In yet another example, exhaust gas sensor degradation may be indicated by parameters estimated from two operation models, a rich combustion model and a lean combustion model. Commanded air-fuel ratio and the air-fuel ratio indicated by the exhaust gas sensor may be compared with the assumption that the combustion that generated the air-fuel ratio was rich (e.g., inputting the commanded lambda into the rich model) and also compared assuming that the combustion event was lean (e.g., inputting the commanded lambda into the lean model). For each model, a set of parameters may be estimated that best fits the commanded lambda values with the measured lambda values. The model parameters may include a time constant, time delay, and static gain of the model. The estimated parameters from each model may be compared to each other, and the type of sensor degradation (e.g., filter vs. delay) may be indicated based on differences between the estimated parameters.

One or more of the above methods for diagnosing degradation of the exhaust gas sensor may be used in the routines described further below (FIGS. 10-13). These methods may be used to determine if the exhaust gas sensor is degraded and if so, what type of degradation has occurred (e.g., filter or delay type). Further, these methods may be used to determine the magnitude of the degradation. Specifically, the above methods may determine a degraded time constant and/or time delay.

After determining the exhaust gas sensor is degraded, one of the methods discussed above may be used to determine the time constant and/or time delay of the degraded response. These parameters may be referred to herein as the degraded (e.g., faulted) time constant, $T_{C-F}$, and the degraded time delay, $T_{D-f}$. The degraded time constant and time delay may then be used, along with the nominal time constant, $T_{C-nom}$, and nominal time delay, $T_{D-nom}$, to determine adjusted parameters of the anticipatory controller. As discussed above, the adjusted parameters of the anticipatory controller may include a proportional gain, $K_P$, an integral gain, $K_I$, a controller time constant, $T_{C-SP}$, and controller time delay, $T_{D-SP}$. The adjusted controller parameters may be further based on the nominal system parameters (e.g., parameters pre-set in the anticipatory controller). By adjusting the controller gains and time constant and time delay of the SP delay compensator, accuracy of the air-fuel ratio command tracking may increase and the stability of the anticipatory controller may increase. As such, after applying the adjusted controller parameters within the exhaust gas sensor system, the engine controller may adjust fuel injection timing and/or amount based on the air-fuel ratio output of the exhaust gas sensor. In some embodiments, if the exhaust gas sensor degradation exceeds a threshold, the engine controller may additionally alert the vehicle operator.

As discussed above, in response to an asymmetric filter type degradation behavior, the engine controller may respond asymmetrically to deliver more or less fuel in the direction of the degradation (e.g., during the lean-to-rich transition or the rich-to-lean transition). This asymmetric operation may cause an increase in CO emissions or an increase in NOx. Instead, the controller of the exhaust gas sensor may transform the asymmetric response to a symmetric response. The transformed symmetric response may then be used as the input for adjusting parameters of the anticipatory controller and subsequently adjusting fuel injection to the engine.

FIG. 9 shows graphical examples of a degraded asymmetric filter response and a transformed symmetric filter response. Specifically, graph 902 shows a commanded lambda at plot 906, an expected lambda at plot 908, and a degraded lambda at plot 910, similar to the lambdas described with respect to FIGS. 2-7. As seen at plot 908, the expected lambda is symmetric around stoichiometry (e.g., lambda=1). In other words, the lean peak amplitude 912 and the rich peak amplitude 914 of the expected lambda (e.g., expected response) are substantially equal.

The degraded lambda shown at plot 910 illustrates a rich-to-lean asymmetric filter degradation wherein the rate of response to the commanded air-fuel ratio change is delayed in the rich-to-lean direction (e.g., transition). The degraded lambda (e.g., degraded response) is asymmetric around stoichiometry. Specifically, the lean peak amplitude 916 and the rich peak amplitude 914 are not equal. Since the asymmetric filter degradation is in the rich-to-lean direction, the rich peak amplitudes of the expected response (plot 908) and the degraded response (plot 910) are substantially the same. However, the lean peak amplitude 916 of the degraded response (plot 910) is smaller than the lean peak amplitude 912 of the expected response (plot 908). Thus, as shown by line 918, the asymmetric filter degradation causes the engine system operation to deviate from stoichiometry.

The asymmetric degraded response (plot 910) includes a faster portion 920 and a slower portion 922 of the response. During the faster portion 920, the degraded response (plot 910) follows the expected response (plot 908). In other words, a slope of the faster portion 920 of the degraded response is substantially the same as a slope of the expected response. During the slower portion 922, the slope of the degraded response (plot 910) is smaller than the slope of the expected response (908), thereby resulting in the smaller lean peak amplitude 916. Thus, for the rich-to-lean filter degradation behavior, the degraded response exhibits a slower response in only the rich-to-lean direction while the other direction (e.g., lean-to-rich) exhibits a faster or expected response rate.

As discussed further below, in response to an asymmetric filter degradation response (such as the asymmetric filter degradation response shown at plot 902), a controller (such as dedicated controller 140 or controller 12 shown in FIG. 1) may transform or convert the asymmetric response to a more symmetric response. The converted symmetric response may be based on magnitude (e.g., time constant) of the asymmetric response. Graph 904 shows an example of a symmetric response (shown at plot 928) resulting from a transformation of the asymmetric response (plot 910) shown in graph 902.

Specifically, graph 904 shows the same commanded lambda and expected lambda as shown in graph 902 at plots 924 and 926, respectively. Additionally, graph 904 shows a filtered or transformed degraded lambda (e.g., degraded response) at plot 928. The transformed degraded response may be achieved by filtering the faster portion 920 (e.g., non-degraded portion) of the asymmetric degraded response (plot 910) by an amount based on the time constant of the slower portion 922 (e.g., degraded portion) of the asymmetric degraded response. As a result of applying this filter, the transformed degraded response (plot 928) is more symmetric around stoichiometry than the degraded response shown at plot 910. As shown at plot 928, the lean peak amplitude 930 and the rich peak amplitude 932 are substantially the same. In other examples, the lean peak amplitude 930 and the rich peak amplitude 932 of the transformed degraded response may be within a threshold of one another. This threshold may be smaller than the difference between the rich peak amplitude 914 and the lean peak amplitude 916 of the asymmetric degraded response (plot 910). Further details on a method for transforming an asymmetric filter degradation response of an exhaust gas sensor to a more symmetric response are presented at FIG. 10.

In alternate examples, the exhaust gas sensor may experience asymmetric filter degradation with degradation in both transition directions. For example, the lean-to-rich transition may be degraded by a first amount (e.g., having a first time constant) and the rich-to-lean transition may be degraded by a second amount (e.g., having a second time constant), the first amount and the second amount being different. In one example, the first time constant may be greater than the second time constant, thereby resulting in a slower response in the lean-to-rich direction than the rich-to-lean direction. In this example, the lean-to-rich transition direction may be filtered so that it has a similar time constant to the second time constant. In this way, the asymmetric response may become more symmetric around stoichiometry.

In this way, an engine method may include adjusting fuel injection responsive to a modified exhaust oxygen feedback signal from an exhaust gas sensor, the modified exhaust oxygen feedback signal modified by transforming an asymmetric response of the exhaust gas sensor to a more symmetric response. The asymmetric response may be an asymmetric filter degradation type response. In one example, transforming the asymmetric response to the more symmetric response may include filtering a non-degraded portion of the asymmetric response by an amount based on a time constant of a degraded portion of the asymmetric response. The method may further include adjusting one or more parameters of an anticipatory controller of the exhaust gas sensor based on the modified symmetric response. In one example, the one or more parameters may include a proportional gain, an integral gain, a controller time constant, and a controller time delay. Further, the adjusted one or more parameters of the anticipatory controller may be applied in both transition directions (e.g., in the lean-to-rich transition direction and the rich-to-lean transition direction). The method may further include determining an air-fuel ratio from the exhaust gas sensor and adjusting fuel injection based on the determined air-fuel ratio.

Now turning to FIG. 10, a method 1000 is shown for converting an asymmetric filter degradation response of an exhaust gas sensor to a more symmetric filter degradation response. Method 1000 may be carried out by a control system of a vehicle, such as controller 12 and/or dedicated controller 140, to monitor an air-fuel ratio response via a sensor such as exhaust gas sensor 126.

Method 1000 begins at 1002 by determining engine operating conditions. Engine operating conditions may be determined based on feedback from various engine sensors, and may include engine speed and load, air-fuel ratio, temperature, etc. Method 1000 then proceeds to 1004. Based on the conditions at 1002, method 1000 determines at 1004 if exhaust gas sensor monitoring conditions are met. In one example, this may include if the engine is running and if selected conditions are met. For example, the selected conditions may include that the input parameters are operational and/or that the exhaust gas sensor is at a temperature whereby it is outputting functional readings. Further, the selected conditions may include that combustion is occurring in the cylinders of the engine, e.g. that the engine is not in a shut-down mode such as deceleration fuel shut-off (DFSO), or that the engine is operating in steady-state conditions.

If it is determined that the engine is not running and/or the selected conditions are not met, method 1000 returns and does not monitor exhaust gas sensor function. However, if the exhaust gas sensor conditions are met at 1004, the method proceeds to 1006 to collect input and output data from the exhaust gas sensor. This may include collecting and storing air-fuel ratio (e.g., lambda) data detected by the sensor. The method at 1006 may continue until a necessary number of samples (e.g., air-fuel ratio data) are collected for the degradation determination method at 1008.

At 1008, method 1000 includes determining if the exhaust gas sensor is degraded, based on the collected sensor data. The method at 1008 may further include determining the type of degradation or degradation behavior of the exhaust gas sensor (e.g., filter vs. delay degradation). As described above, various methods may be used to determine exhaust gas sensor degradation behavior. In one example, degradation may be indicated based on a time delay and line length of each sample of a set of exhaust gas sensor responses collected during a commanded change in air-fuel ratio. A degraded time delay and time constant, along with a line length, may be determined from the exhaust gas sensor response data and compared to expected values. For example, if the degraded time delay is greater than the expected time delay, the exhaust gas sensor may be exhibiting a delay degradation behavior (e.g., degraded time delay). If the determined line length is greater than the expected line length, the exhaust gas sensor may be exhibiting a filter degradation behavior (e.g., degraded time constant). In another example, if the line length is greater than expected in both transition directions (e.g., for both lean-to-rich and rich-to-lean transitions), the exhaust gas sensor may be exhibiting an asymmetric filter degradation behavior.

In another example, exhaust gas sensor degradation may be determined from characteristics of a distribution of extreme values from multiple sets of successive lambda samples during steady state operating conditions. The characteristics may be a mode and central peak of a generalized extreme value (GEV) distribution of the extreme lambda differentials collected during steady state operating conditions. The magnitude of the central peak and mode, along with a determined time constant and time delay, may indicate the type of degradation behavior, along with the magnitude of the degradation.

In yet another example, exhaust gas sensor degradation may be indicated based on a difference between a first set of estimated parameters of a rich combustion model and a second set of estimated parameters of a lean combustion model. The estimated parameters may include the time constant, time delay, and static gain of both the commanded lambda (air-fuel ratio) and the determined lambda (e.g., determined from exhaust gas sensor output). The type of exhaust gas sensor degradation (e.g., filter vs. delay and asymmetric vs. symmetric) may be indicated based on differences between the estimated parameters. It should be noted that an alternative method to the above methods may be used to determine exhaust gas sensor degradation.

After one or more of the above methods are employed, the method continues on to 1010 to determine if asymmetric filter degradation (e.g., time constant degradation in both transition directions) is detected. If asymmetric filter degradation is not detected, the method continues on to 1012 where the method proceeds to 1102 in FIG. 11 to determine the type of degradation and subsequently adjust parameters of the anticipatory controller. Alternatively at 1010, if asymmetric filter degradation is detected, the method continues on to 1014 to convert the degraded asymmetric response (e.g., response from the exhaust gas sensor exhibiting asymmetric filter degradation behavior) to a symmetric response.

The method at 1014 may include transforming the asymmetric degraded response to an equivalent symmetric degraded response. The transformed degraded response may be achieved by filtering the faster transition, or non-degraded, portion of the asymmetric degraded response by an amount based on the time constant of the slower, or degraded, portion of the asymmetric degraded response. In other words, the degradation may be induced in the non-degraded transition direction so that the resulting response is degraded in both transitions (e.g., both lean-to-rich and rich-to-lean). For example, if the asymmetric filter degradation response is an asymmetric lean-to-rich filter type degradation response, the lean-to-rich transition is slow compared to the expected response while the rich-to-lean transition is not degraded (e.g., faster). Thus, in this example, the rich-to-lean transition may be filtered with the filter based on the magnitude (e.g., time constant) of the slow lean-to-rich transition. The end result of the filtering the non-degraded portion of the asymmetric response may be a symmetric filter degradation type response with the same magnitude, or time constant, as the degraded portion of the asymmetric filter degradation response.

In one example, the method at 1014 may include determining the magnitude (e.g., time constant) and direction of the degraded response (e.g., lean-to-rich or rich-to-lean). Any of the methods discussed above for determining sensor degradation may be used to determine the magnitude and direction of the asymmetric filter degradation response. Then, the asymmetric filter degradation response may be filtered in the non-degraded direction by an amount based on the degraded time constant. In one example, a function or algorithm may perform the filtering with the raw asymmetric filter response, the degraded time constant, and a desired sampling time for the new symmetric filter response as inputs. As discussed above, the resulting response may be a symmetric filter degradation response which exhibits degradation of substantially the same magnitude as the unfiltered degraded response in both transition directions. For example, if the degraded response is determined to be a rich-to-lean filter degradation response, the degraded response is filtered in the lean-to-rich direction. Conversely, if the degraded response is determined to be a lean-to-rich filter degradation response, the degraded response is filtered in the rich-to-lean direction.

After transforming the asymmetric filter degradation response to a symmetric filter degradation response, the method continues on to 1016 to adapt parameters of the anticipatory controller of the exhaust gas sensor based on the modified symmetric response. The method continues to 1102 at FIG. 11.

As discussed above, the anticipatory controller parameters may be adjusted based on the type of oxygen sensor degradation (e.g., filter vs. delay degradation). For example, the integral gain may be adjusted responsive to both the delay degradation and the filter degradation. Adjusting the integral gain may be based on one or more of the degraded time delay and the degraded time constant. The proportional gain may be adjusted by a first amount responsive to the delay degradation and adjusted by a second, different, amount responsive to the filter degradation. The adjusting the proportional gain by the first amount may be based on the degraded time delay while adjusting the proportional gain by the second amount may be based on the degraded time constant. The controller time constant may be adjusted responsive to the filter degradation and not adjusted responsive to the delay degradation. Adjusting the controller time constant may be based on the degraded time constant. Finally, the controller time delay may be adjusted by a first amount responsive to the filter degradation and adjusted by a second amount responsive to the delay degradation. Adjusting the controller time delay by the first amount may be based on the degraded time constant while adjusting the controller time delay by the second amount may be based on the degraded time delay.

Turning now to FIG. 11, an example method 1100 for adjusting parameters of an anticipatory controller of an exhaust gas sensor, based on a type and magnitude of degradation is depicted. Method 1100 continues on from either 1012 or 1016 in FIG. 10 wherein either no asymmetric filter degradation was detected or the asymmetric filter degradation type response was transformed into a symmetric filter degradation type response, respectively.

At 1102, the method includes determining if filter degradation (e.g., time constant degradation) is detected. If filter degradation is not detected, the method continues on to 1104 to determine if delay degradation is detected (e.g., time delay degradation). If delay degradation is also not detected, the method determines at 1106 that the exhaust gas sensor is not degraded. The parameters of the anticipatory controller are maintained and the method returns to continue monitoring the exhaust gas sensor.

Returning to 1102, if a filter type degradation is indicated, the method continues on to 1108 to approximate the system by a first order plant with delay model (e.g., FOPD). This may include applying a half rule approximation to the nominal time constant, nominal time delay, and degraded time constant to determine equivalent first order time constant and time delay. The method may further include determining adjusted controller gains. Further details on the method at 1108 are presented at FIG. 12.

Alternatively, if a delay type degradation is indicated at 1104, the method continues on to 1110 to determine an equivalent or new time delay in the presence of the degradation. The method further includes determining adjusted anticipatory controller parameters, including controller gains and controller time constant and time delay (used in delay compensator). Further details on the method at 1110 are presented at FIG. 13.

From 1108 and 1110, method 1100 continues on to 1112 to apply the newly determined anticipatory controller parameters. The exhaust gas sensor may then use these parameters in the anticipatory controller to determine the measured air-fuel ratio. At 1114, the method includes determining the air-fuel ratio from the exhaust gas sensor and adjusting fuel injection and/or timing based on the determined air-fuel ratio. For example, this may include increasing the amount of fuel injected by the fuel injectors if the air-fuel ratio is above a threshold value. In another example, this may include decreasing the amount of fuel injected by the fuel injectors if the air-fuel ratio is below the threshold value. In some embodiments, if the degradation of the exhaust gas sensor exceeds a threshold, method 1100 may include notifying the vehicle operator at 1116. The threshold may include a degraded time constant and/or time delay over a threshold value. Notifying the vehicle operator at 1116 may include sending a notification or maintenance request for the exhaust gas sensor.

FIG. 12 is a flow chart illustrating a method 1200 for determining adjusted parameters of the anticipatory controller of the exhaust gas sensor based on filter degradation behavior. Method 1200 may be carried out by controller 12 and/or dedicated controller 140, and may be executed during 1108 of method 1100 described above. At 1202, method 1200 includes estimating the degraded time constant, $T_{C-F}$, and the nominal time constant, $T_{C-nom}$. As discussed above, the nominal time constant may be the time constant indicating how quickly the sensor responds to a commanded change in lambda, and may be determined off-line based on non-degraded sensor function. The degraded time constant may be estimated using any of the methods for determining degradation at 1008 in method 1000, as discussed above.

After determining the degraded time constant $T_{C-F}$ and the nominal time constant $T_{C-nom}$, method 1200 proceeds to 1204 to approximate the second order system by a first order model (e.g., FOPD). The method at 1204 may include applying a half rule approximation to the degraded system. The half rule approximation includes distributing the smaller time constant (between the nominal and degraded time constants) evenly between the larger time constant and the nominal time delay. This may be done using the following equations:

$$T_{C-Equiv}=\mathrm{MAX}(T_{C-F},T_{C-nom})+\tfrac{1}{2}*\mathrm{MIN}(T_{C-F},T_{C-nom})$$

$$T_{D-Equiv}=T_{D-nom}+\tfrac{1}{2}*\mathrm{MIN}(T_{C-F},T_{C-nom})$$

If the degraded time constant $T_{C-F}$ is smaller than the nominal time constant $T_{C-nom}$ the equations become:

$$T_{C-Equiv}=T_{C-nom}+\tfrac{1}{2}T_{C-F}$$

$$T_{D-Equiv}=T_{D-nom}+\tfrac{1}{2}T_{C-F}$$

At 1206, the controller may replace the controller time constant, $T_{C-SP}$, and the controller time delay, $T_{D-SP}$, used in the SP delay compensator (in the anticipatory controller) with the determined equivalent time constant, $T_{C-Equiv}$, and the equivalent time delay, $T_{D-Equiv}$.

At 1208, the controller determines an intermediate multiplier, alpha, of the anticipatory controller. The intermediate multiplier is defined by the following equation:

$$\mathrm{Alpha}=\frac{T_{D-nom}}{(T_{D-Equiv})}$$

The intermediate multiplier alpha may be used to determine the integral gain $K_I$ of the anticipatory controller at 1210. The integral gain $K_I$ is determined from the following equation:

$$K_I=\mathrm{alpha}*K_{I-nom}$$

Where $K_{I-nom}$ is the nominal integral gain of the anticipatory controller. Since alpha=1 for a filter degradation, $K_I$ is maintained at the nominal value.

Finally, at 1212, the controller determines the proportional gain, $K_P$, based on the integral gain $K_I$ and the equivalent time constant $T_{C-Equiv}$. The proportional gain $K_P$ is determined from the following equation:

$$K_P=T_{C-Equiv}*K_I$$

As the magnitude of the filter degradation increases (e.g., as the degraded time constant increases), the equivalent time constant $T_{C-Equiv}$ increases, thereby increasing $K_P$. After determining the new anticipatory controller parameters, the method returns to 1108 of method 1100 and continues on to 1112 to apply the new controller parameters.

In this way, the anticipatory controller gains, time constant, and time delay may be adjusted based on the magnitude and type of degradation behavior. Specifically, for a filter type degradation (e.g., time constant degradation), the proportional gain, the integral gain, and controller time constant and time delay ($T_{C-SP}$ and $T_{D-SP}$) may be adjusted based on the degraded time constant.

FIG. 13 is a flow chart illustrating a method 1300 for determining adjusted parameters of the anticipatory controller of the exhaust gas sensor based on delay degradation behavior. Method 1300 may be carried out by controller 12 and/or dedicated controller 140, and may be executed during 1110 of method 1100 described above. At 1302, method 1300 includes estimating the degraded time delay, $T_{D-F}$, and the nominal time delay, $T_{D-nom}$. As discussed above, the nominal time delay is the expected delay in exhaust gas sensor response to a commanded air-fuel ratio change based on the delay from when the fuel is injected, combusted, and the exhaust travels from the combustion chamber to the exhaust sensor. The degraded time delay $T_{D-F}$ may be estimated using any of the methods for determining degradation at 1008 in method 1000, as discussed above.

After determining the degraded time delay $T_{D-F}$ and the nominal time delay $T_{D-nom}$, method 1300 proceeds to 1304 to determine the equivalent time delay, $T_{D-Equiv}$, based on the degraded time delay $T_{D-F}$ and the nominal time delay $T_{D-nom}$. The equivalent time delay $T_{D-Equiv}$ may be estimated by the following equation:

$$T_{D-Equiv}=T_{D-nom}+T_{D-F}$$

In this way, the equivalent time delay is the extra time delay (e.g., degraded time delay) after the expected time delay (e.g., nominal time delay).

The time constant may not change for a delay degradation. Thus, at 1306, the equivalent time constant $T_{C-Equiv}$ may be set to the nominal time constant $T_{C-nom}$. At 1308, the controller may replace the controller time constant, $T_{C-SP}$, and the controller time delay, $T_{D-SP}$, used in the SP delay compensator (in the anticipatory controller) with the determined equivalent time constant, $T_{C-Equiv}$, and the equivalent time delay, $T_{D-Equiv}$. For the delay degradation, the controller time constant $T_{C-SP}$ may remain unchanged.

At 1310, the controller determines the intermediate multiplier, alpha, of the anticipatory controller. The intermediate multiplier may be based on the degraded time delay and the nominal time delay. The intermediate multiplier is defined by the following equation:

$$\text{Alpha} = \frac{T_{D-nom}}{(T_{D-nom} + T_{D-f})}$$

The intermediate multiplier alpha may then be used to determine the integral gain $K_I$ of the anticipatory controller at 1312. The integral gain $K_I$ is determined from the following equation:

$$K_I = \text{alpha} * K_{I-nom}$$

Where $K_{I-nom}$ is the nominal integral gain of the anticipatory controller. As the magnitude of the delay degradation (e.g., value of $T_{DF}$) increases, alpha may decrease. This, in turn, causes the integral gain $K_I$ to decrease. Thus, the integral gain may be reduced by a greater amount as the degraded time delay $T_{D-F}$ and magnitude of the delay degradation increases.

Finally, at 1314, the controller determines the proportional gain, $K_P$, based on the integral gain $K_I$ and the equivalent time constant $T_{C-Equiv}$. The proportional gain $K_P$ is determined from the following equation:

$$K_P = T_{C-Equiv} * K_I$$

Since the equivalent time constant $T_{C-Equiv}$ may not change for a delay type degradation, the proportional gain $K_P$ may be based on the integral gain $K_I$. Thus, as $K_I$ decreases with increasing degraded time delay $T_{D-F}$, the proportional grain $K_P$ also decreases. After determining the new anticipatory controller parameters, the method returns to 1110 of method 1100 and continues on to 1112 to apply the new controller parameters.

In this way, the anticipatory controller gains, time constant, and time delay may be adjusted based on the magnitude and type of degradation behavior. Specifically, for a delay type degradation (e.g., time delay degradation), the proportional gain, integral gain, and controller time delay ($T_{D-SP}$) may be adjusted based on the degraded time delay while the controller time constant ($T_{C-SP}$) is maintained.

As described above, an engine method may include adjusting fuel injection responsive to exhaust oxygen feedback from an exhaust sensor and converting an asymmetric degradation response of the exhaust sensor to a more symmetric degradation response based on a magnitude and direction of the asymmetric degradation response. For example, the asymmetric degradation response may be an asymmetric filter degradation response with a degraded response rate in only one transition direction. Converting the asymmetric degradation response to the more symmetric degradation response may include filtering a non-degraded transition of the asymmetric degradation response and not filtering a degraded transition of the asymmetric degradation response. In one example, filtering the non-degraded transition of the asymmetric response may include filtering a rich-to-lean transition with a low-pass filter when the degraded transition is lean-to-rich. In another example, filtering the non-degraded transition of the asymmetric response may include filtering a lean-to-rich transition when the degraded transition is rich-to-lean. Further, the non-degraded transition of the asymmetric degradation response may be filtered by an amount based on the magnitude of the degraded transition of the asymmetric degradation response. In one example, the magnitude of the degraded transition may be based on a time constant of the degraded transition. The method may further include adjusting one or more parameters of an anticipatory controller of the exhaust gas sensor responsive to the more symmetric degradation response. In one example, adjusting one or more parameters of the anticipatory controller may include applying the one or more parameters in both a lean-to-rich transition direction and a rich-to-lean transition direction.

In this way, an asymmetric filter degradation type response of an exhaust gas sensor may be transformed to a modified symmetric filter degradation response. Specifically, upon determining the exhaust gas sensor is degraded and a type of degradation is an asymmetric filter type degradation behavior, a controller may convert the asymmetric filter degradation response to the modified symmetric filter degradation response. The converting may include filtering the asymmetric filter degradation response by an amount based on a magnitude and direction of the asymmetric filter degradation response. The magnitude of the asymmetric filter degradation response may be the time constant and the direction of the asymmetric filter degradation response may be the transition direction (e.g., lean-to-rich or rich-to-lean) that is degraded. For example, the controller may filter only a non-degraded transition of the asymmetric filter degradation response. The filter or amount of filtering may be based on a time constant (e.g., magnitude) of a degraded transition of the asymmetric filter degradation response. Parameters of an anticipatory controller of the exhaust gas sensor may then be adjusted in both transition directions based on the converted symmetric filter degradation response. Once the anticipatory controller parameters are adjusted, a controller may adjust fuel injection to the engine based on air-fuel ratio feedback from the exhaust gas sensor. Converting an asymmetric filter degradation response to an equivalent symmetric filter degradation response may reduce calibration work of the exhaust gas sensor while also reducing NOx and CO emissions of the engine.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

adjusting fuel injection responsive to an exhaust oxygen feedback signal from an exhaust gas sensor, the exhaust oxygen feedback signal modified by transforming an asymmetric portion of the exhaust oxygen feedback signal to a more symmetric signal, and wherein adjusting fuel injection includes replacing a time constant parameter and a delay parameter in a Smith predictor delay compensator.

2. The method of claim 1, wherein the asymmetric portion is an asymmetric filter degradation type response, and further comprising adjusting an integral gain parameter of a controller that adjusts fuel injection based on a nominal time delay divided by the nominal time delay plus a degraded time delay.

3. The method of claim 1, wherein transforming the asymmetric portion to the more symmetric signal includes filtering a non-degraded portion of the asymmetric portion of the exhaust oxygen feedback signal by an amount based on a time constant of a degraded portion of the asymmetric portion of the exhaust oxygen feedback signal.

4. The method of claim 1, further comprising adjusting one or more parameters of an anticipatory controller of the exhaust gas sensor based on the more symmetric signal.

5. The method of claim 4, wherein the one or more parameters includes a proportional gain, an integral gain, a controller time constant, and a controller time delay.

6. The method of claim 4, further comprising applying the adjusted one or more parameters of the anticipatory controller in both transition directions.

7. The method of claim 1, further comprising determining an air-fuel ratio from the exhaust gas sensor and adjusting fuel injection based on the determined air-fuel ratio.

8. An engine method, comprising:

adjusting fuel injection responsive to exhaust oxygen feedback from an exhaust sensor; and converting an asymmetric degradation portion of a signal from the exhaust sensor to a more symmetric signal, wherein converting the asymmetric degradation portion of the signal includes adjusting the signal from the exhaust sensor based on a magnitude and direction of the asymmetric degradation portion of the signal, and wherein adjusting fuel injection includes replacing a time constant parameter and a delay parameter in a Smith predictor delay compensator.

9. The method of claim 8, wherein the more symmetric signal includes an asymmetric filter degradation response with a degraded response rate in only one transition direction.

10. The method of claim 9, wherein converting the asymmetric degradation portion of the signal from the exhaust sensor to the more symmetric signal includes filtering a non-degraded transition of the asymmetric degradation portion of the signal from the exhaust sensor and not filtering a degraded transition of the asymmetric degradation portion of the signal from the exhaust sensor.

11. The method of claim 10, wherein filtering the non-degraded transition of the asymmetric degradation portion of the signal from the exhaust sensor includes filtering a rich-to-lean transition with a low-pass filter when the degraded transition is lean-to-rich.

12. The method of claim 10, wherein filtering the non-degraded transition of the asymmetric degradation portion of the signal from the exhaust sensor includes filtering a lean-to-rich transition when the degraded transition is rich-to-lean, and further comprising adjusting an integral gain parameter of a controller that adjusts fuel injection based on a nominal time delay divided by the nominal time delay plus a degraded time delay.

13. The method of claim 10, wherein filtering includes filtering the non-degraded transition of the asymmetric degradation portion of the signal from the exhaust sensor by an amount based on a magnitude of the degraded transition of the asymmetric degradation portion of the signal from the exhaust sensor.

14. The method of claim 13, wherein the magnitude of the degraded transition is based on a time constant of the degraded transition.

15. The method of claim 8, further comprising adjusting one or more parameters of an anticipatory controller of the exhaust sensor responsive to the more symmetric signal.

16. The method of claim 15, wherein adjusting one or more parameters of the anticipatory controller includes applying the one or more parameters in both a lean-to-rich transition direction and a rich-to-lean transition direction.

17. A system for a vehicle, comprising:

an engine including a fuel injection system;

an exhaust gas sensor coupled in an exhaust gas system of the engine, the exhaust gas sensor having an anticipatory controller; and a controller including instructions stored in non-transitory memory executable to transform in the controller an asymmetric degradation signal of the exhaust gas sensor to a modified symmetric degradation signal based on a magnitude and direction of the asymmetric degradation signal, and further comprising instructions to adjust an integral gain parameter of a controller that adjusts fuel injection based on a nominal time delay divided by the nominal time delay plus a degraded time delay.

18. The system of claim 17, wherein the instructions executable to transform the asymmetric degradation signal include filtering a non-degraded transition direction of the asymmetric degradation signal based on a time constant of a degraded transition direction of the asymmetric degradation signal.

19. The system of claim 17, wherein the instructions further include adjusting one or more parameters of the anticipatory controller responsive to the modified symmetric degradation signal, wherein an amount of adjusting is based on a magnitude of the modified symmetric degradation signal.

20. The system of claim 17, wherein an amount of fuel and/or timing of the fuel injection system is adjusted based on exhaust oxygen feedback from the anticipatory controller, and further comprising instructions to replace a time constant parameter and a delay parameter in a Smith predictor delay compensator in the controller.

* * * * *